United States Patent [19]

Hoyt

[11] 4,185,441

[45] Jan. 29, 1980

[54] PACKAGING STATION

[76] Inventor: William H. Hoyt, P.O. Box 551, Choteau, Mont. 59422

[21] Appl. No.: 883,909

[22] Filed: Mar. 6, 1978

[51] Int. Cl.[2] ..... B65B 31/04

[52] U.S. Cl. ..... 53/79; 53/512

[58] Field of Search ..... 53/79, 512; 417/403

[56] References Cited

U.S. PATENT DOCUMENTS

| | | | |
|---|---|---|---|
| 30,440 | 10/1860 | Widey | 53/79 |
| 2,606,696 | 8/1952 | Miner | 417/403 X |
| 2,651,444 | 9/1953 | Casey et al. | 53/79 |

*Primary Examiner*—Travis S. McGehee

*Attorney, Agent, or Firm*—Arthur L. Urban

[57] ABSTRACT

A packaging station including a work surface, a vacuum line with an opening adjacent to the work surface, the vacuum line being connected to a first cylinder, a first piston movably disposed within the first cylinder, a second cylinder located adjacent to the first cylinder, a second piston movably disposed within the second cylinder and operatively connected to the first piston, means for providing the fluid under pressure to the second cylinder, and control means for controlling the flow of the fluid selectively to the second cylinder on one side of the second piston therein.

10 Claims, 3 Drawing Figures

PACKAGING STATION

This invention relates to a novel packaging station and more particularly relates to a new packaging station for flexible film packages.

The use of flexible plastic films in packaging has become widespread in recent years because it is convenient to use and because it provides an inexpensive airtight enclosure. The plastic films employed generally are of the shrinkable type so the film can be drawn tightly around the item being packaged. This is accomplished ordinarily by subjecting the package to heat after the item is wrapped. The heat causes the film to shrink around the item giving the package a smooth appearance.

The use of shrink film packaging techniques is advantageous for meats and other food items because it reduces the amount of air which can come into contact with the food. Meat and many other foods can be stored for longer periods of time if the food does not come into contact with air.

While the packaging of food using the above procedures does increase its storage life, the small amount of air which remains in the package in contact with the food still has an adverse effect on the storage life of the item.

It has been proposed to remove the air from the package prior to sealing and heat shrinkage thereof. The use of vacuum packing in combination with heat shrinkage has provided a substantial increase in the storage life of food items and particularly meats. Whereas meats packaged with a shrink type plastic film have a useful storage of about one week ordinarily, a similarly packaged meat item which also has had the air removed before sealing and shrinkage can be stored for several weeks successfully.

While vacuum packaging enables foods to be stored for much longer periods of time, the procedures presently being practiced leave much to be desired. For example, a large vacuum pump ordinarily is required in combination with a vacuum reservoir tank. The pump which must be of considerable size and power, runs continuously to maintain the desirable vacuum in the tank. The pump and tank are costly both in their original equipment investment and in the operating cost of the pump. Furthermore, such pumps are quite noisy and require installation in a soundproof room or in a location remote from the packaging personnel.

A further disadvantage of the above system is the extra time required to withdraw the air from the package. Extra time not only is involved in the manipulation of the package but also in the time required for the vacuum system to draw the air from the package. Since the packaging station generally is remote from the vacuum pump and tank because of the noise of the equipment, there is a delay in the development of the vacuum at the packaging station and in the removal of the air from the package. These delays can significantly reduce the efficiency and productivity of the personnel doing the packaging. It is apparent from the above discussion that although the vacuum packaging of food items in plastic film allows much longer storage, the equipment and procedures presently utilized have a number of serious shortcomings.

The present invention provides a novel packaging station which is less costly than present equipment both from the standpoint of its original investment and from the cost of operating the equipment. The packaging station of the invention also uses less energy in its operation. Furthermore, the system operates at a lower noise level than present systems. This reduces installation costs since physical and/or acoustic isolation of the equipment is not required. Moreover, the packaging station provides substantially instantaneous vacuum for the operator and thus avoids delays in packaging. As a result, the packaging station of the invention allows packaging personnel to improve their efficiency and productivity significantly.

Other benefits and advantages of the novel packaging station of the present invention will be apparent from the following description and the accompanying drawings in which.

Figure 1:
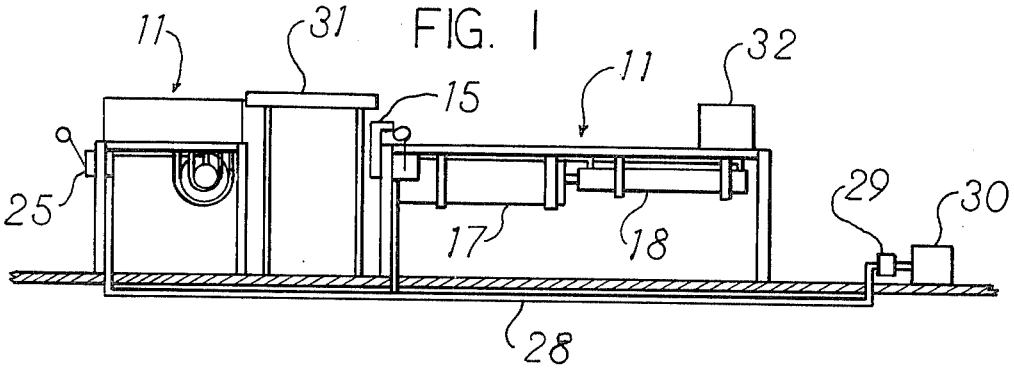
FIG. 1 is a schematic illustration of a packaging plant including novel packaging stations of the present invention with a side elevation of one station and an end view of a second station.
Figure 2:
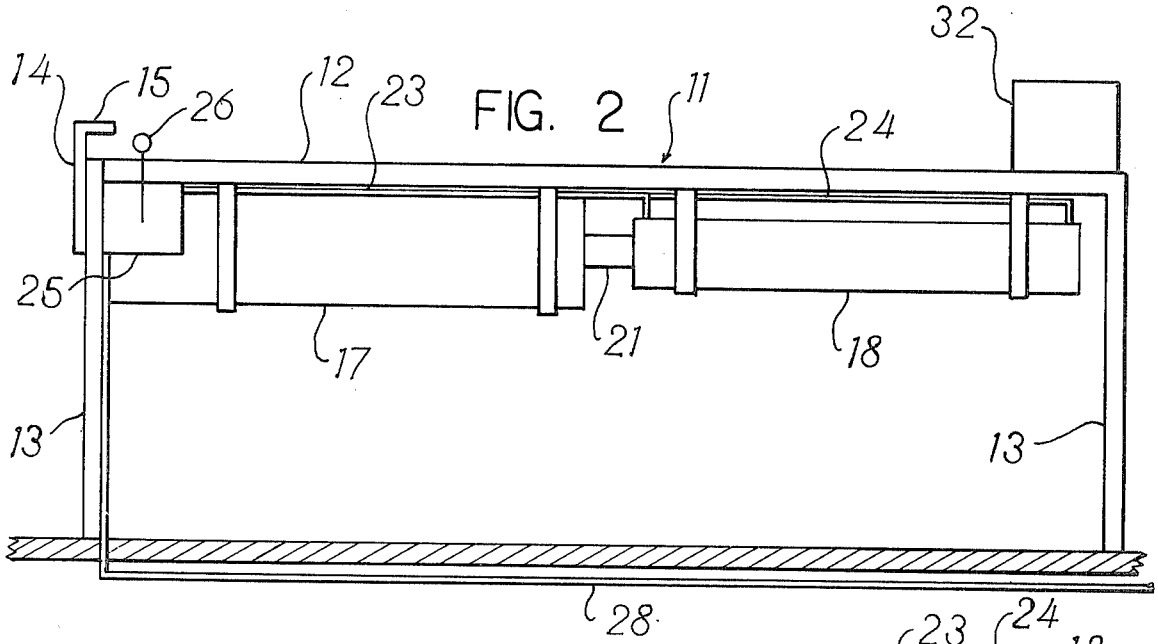
FIG. 2 is an enlarged side elevation of a packaging station shown in FIG. 1.

As shown in the drawings, a novel packaging station 11 of the present invention includes a work surface 12 which may be the top of a table with legs 13 as shown. A vacuum line 14 with an opening 15 is disposed adjacent to work surface 12. Vacuum line 14 may extend upwardly through an opening in the work surface or as shown in the drawings may extend around an edge of the work surface 12.

Below work surface 12 are located an air cylinder 17 and a hydraulic cylinder 18. A movable piston 19 is disposed within air cylinder 17 and a second movable piston 20 is disposed within a fluid cylinder 18. Pistons 19 and 20 are operatively connected by a common connecting rod 21. Piston 19 has a one-way check valve 22.

Fluid lines 23 and 24 are connected to the opposite ends of cylinder 18. The fluid lines terminate at control 25 which has a handle 26. A fluid line 28 from control 25 connects with a source of fluid under pressure. The hydraulic fluid-providing means may be a pump 29 driven by a motor 30. A single pump 29 may service several packaging stations 11 as shown in FIG. 1.

In the operation of the novel packaging station of the present invention shown in the drawings, a packager stands next to one of the packaging stations 11 near the opening 15 of line 14 and the control handle 26. Meat or other food items to be packaged are delivered to the packaging station. For example, as shown the meat may delivered to the packaging station on a conveyor 31. The packager removes the meat from the conveyor 31 and places the item in a plastic bag or wraps it in a plastic film from a dispenser 32.

The packager then places the open end of the bag over the end 15 of line 14. He holds the bag opening tightly around the line 14 with one hand while he moves control handle 26 with his other hand. After the air in the bag is withdrawn through line 14, the packager seals the end of the bag with a suitable clip or other fastener. The evacuated bag with the meat inside then is transferred to a heating chamber (not shown) where the plastic film of the bag shrinks tightly around the meat.

When the packager moves control handle 26, hydraulic fluid is forced from pump 29, through lines 28 and 23 into one end of cylinder 18. The hydraulic fluid forced into cylinder 18 moves piston 20 disposed therein toward the opposite end of the cylinder. The movement of piston 20 causes piston 19 in cylinder 17 also to move in the same direction since the two pistons are connected by a common connecting rod 21.

Figure 3:
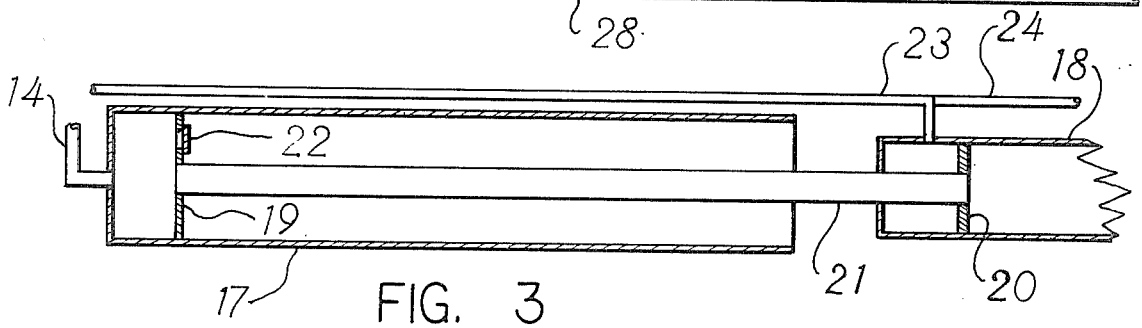
FIG. 3 is a further enlarged fragmentary view of the vacuum generating portion of the packaging station shown in FIG. 2.

The resultant movement of piston 19 away from the end of cylinder 17 connected to line 14, creates a partial vacuum in that portion of the cylinder (the left portion as shown in FIG. 3). This action of the piston 19 draws the air from the bag being held at the end of line 14, through the line and into the left portion of cylinder 17.

After the evacuated bag is removed from the end of line 14, piston 19 is returned to its original position at the left end of cylinder 17. This may be accomplished by activating control 25 again so as to force hydraulic fluid from pump 29 and line 28 through line 24 this time and into the opposite end of cylinder 18. The hydraulic fluid forced into cylinder 18 moves piston 20 back to its original position at the left of the cylinder. Since piston 20 is connected to piston 19 in cylinder 17, the movement of piston 20 will cause piston 19 to be moved toward the left end of cylinder 17 so that it is in position for the evacuation of another bag. Alternatively, the return movement of pistons 19 and 20 attached thereto may be effected automatically using a suitable sensor to detect when the bag is removed from the end of line 14 and a major change in the flow through line 14 occurs.

Advantageously, the stroke of piston 19 within cylinder 17 is of sufficient magnitude to evacuate substantially all of the air from the bag or film package in a single stroke. Preferably, the stroke of piston 19 can be adjusted to accommodate different size packages. Since pump 29 can maintain the hydraulic fluid in the system under a relatively high pressure without difficulty, the size of cylinder 18 may be significantly smaller than the size of cylinder 17. While FIG. 1 illustrates a common pump 29 for several packaging stations, it may be desirable under certain conditions to utilize individual pumps at each station. This is feasible because of the relatively low cost of the fluid pump and its low noise level.

The above description and the accompanying drawings show that the present invention provides a novel packaging station which is relatively inexpensive to fabricate and which uses less energy and thus has a lower operating cost than systems heretofore employed. Further, the packaging station of the invention does not require physical and/or acoustic isolation because of its lower noise level, thus saving on installation costs. Also, the packaging station of the invention provides substantially instantaneous vacuum for the packer which enables him to operate at a high efficiency and with a high productivity rate.

It will be apparent that various modifications can be made in the particular packaging station described in detail above and shown in the drawings within the scope of the invention. For example, the arrangement of the respective cylinders and their disposition with respect to the work surface may be changed. Also, the control may be foot operated if desired. In addition, the size and configuration of the cylinders may be different for specific requirements. Further, a nozzle, a vacuum chamber or the like may be attached to the free end of vacuum line 14 to facilitate evacuation of the air from the food package. Therefore, the scope of the invention is to be limited only by the following claims.

What is claimed is:

1. A packaging station including a work surface, a vacuum line with an opening adjacent to said work surface, said vacuum line being connected to a first cylinder, a first piston movably disposed within said first cylinder, a second cylinder located adjacent to said first cylinder, a second piston movably disposed within said second cylinder and operatively connected to said first piston, means for providing a fluid under pressure to said second cylinder, and control means for controlling the flow of said fluid selectively to said second cylinder on one side of said second piston therein.

2. A packaging station according to claim 1 wherein said first piston and said second piston are operatively connected through a common connecting rod.

3. A packaging station according to claim 1 wherein said first cylinder and said second cylinder are disposed below said work surface.

4. A packaging station according to claim 1 wherein said means for providing fluid is capable of providing said fluid to said second cylinder alternately on each side of said second piston.

5. A packaging station according to claim 1 wherein said first cylinder is of a size and the first piston has a stroke of sufficient magnitude to evacuate substantially all of the air from a package in a single stroke.

6. A packaging station according to claim 5 wherein said stroke of said first piston is adjustable.

7. A packaging station according to claim 1 wherein said second cylinder is of a size significantly smaller than that of said first cylinder.

8. A packaging station according to claim 1 wherein a plurality of packaging stations are operatively connected to a common means for providing fluid under pressure.

9. A packaging station according to claim 8 wherein said means for providing fluid is located adjacent to said packaging stations.

10. A packaging station according to claim 1 wherein a plastic bag or film dispenser is located adjacent to said work surface.

* * * * *